United States Patent [19]

Elbe

[11] 4,167,085

[45] Sep. 11, 1979

[54] MOUNTING ASSEMBLY FOR GEM BLANKS

[75] Inventor: Maximo Elbe, Sierksdorf, Fed. Rep. of Germany

[73] Assignee: Gerda Magnusson, Sierksdorf, Fed. Rep. of Germany

[21] Appl. No.: 813,660

[22] Filed: Jul. 7, 1977

[30] Foreign Application Priority Data

Jul. 12, 1976 [DE] Fed. Rep. of Germany ..... 2631236

[51] Int. Cl.[2] ..... B24B 19/00

[52] U.S. Cl. ..... 51/229; 279/1 SG; 279/23 A

[58] Field of Search ..... 279/1 SG, 1 D, 23, 24, 279/28; 51/229

[56] References Cited

U.S. PATENT DOCUMENTS

| | | | |
|---|---|---|---|
| 2,513,138 | 6/1950 | Burness | 51/229 |
| 2,779,138 | 1/1957 | Collar | 51/229 X |
| 2,877,022 | 3/1959 | Parker | 279/1 Q |
| 3,098,327 | 7/1963 | Malin | 51/229 |
| 3,135,073 | 6/1964 | Odle | 51/229 |
| 3,163,433 | 12/1964 | Ross | 279/1 D |
| 3,779,566 | 12/1973 | Tarbox | 279/1 S |

*Primary Examiner*—Harold D. Whitehead

*Attorney, Agent, or Firm*—Toren, McGeady and Stanger

[57] ABSTRACT

A mounting assembly for mounting precious stones such as gem blanks in a cutting and/or polishing machine comprising a self-clamping type chuck in an adjustable threaded engagement with a first inner detent ring provided with divisions for interstices and semi-interstices for defining a plurality of predetermined angular positions, the first detent ring being fitted into a second external detent ring likewise provided with a predetermined division and serving as a guide for the first inner detent ring. The chuck is mounted within a carrier having a bore for a shaft portion of the chuck. The angular position of the chuck is adjusted and locked by the detent ring assembly.

6 Claims, 11 Drawing Figures

MOUNTING ASSEMBLY FOR GEM BLANKS

The present invention relates to a mounting assembly for mounting precious stones such as gem blanks in a cutting and/or polishing machine comprising a detent assembly for a carrier and a chuck for holding a stone which is to be cut and polished. The here employed term "precious stone" or "gem" is intended to designate various materials, that is natural and synthetic materials and particularly likewise diamonds.

Heretofore have been used detent devices as well as clamping devices for precious stones allowing a more precise machining in the facet angles. When the gem industry became aware of the fact that cutting of facets by sight and by means of magnifying glasses depended upon the skill of a cutting operator, there have been developed mechanical devices for overcoming these drawbacks. These detent devices generally provide a division of 64 and allow cutting of the facets by interstices and the like. The cutting operator must now select the correct tooth among the 64 teeth of the detent device. A single error ruins the precious stone.

By the German Laying-Open specifications Nos. 1,652,168 and 1,652,169 there have become known slotted mounts for precious stones. These amounts include an exterior slim cone adapted to be engaged into a receiver so that the precious stone intended to be cut is rigidly retained in the mount. A longitudinal adaptation is required since stones of different sizes result in different lengths unless the cone is exchanged for every stone size. Experience has shown that the mount after cutting a stone is no longer useable because the mount has been partly ground away. This German Laying-Open specification furthermore provides a contact ring for making electrical contact with the non-combined cutting wheel as soon as the correct depth of facet has been obtained. Mount and metallic contact ring necessarily destroy the non-combined cutting wheel because the insulating diamond grain must be removed from the cutting wheel in order to allow the electrical contact to be made.

In the German Laying-Open specification No. 2,314,563 has been described a detent positioning of the facet angles by means of electric motors but the precision of angular positioning by these motors is insufficient.

A brilliant must comply with a specific geometrical configuration. The Rondist thereof must not exhibit any visible devi-ations in strength. Generally are demanded strengths of from 1 to 3% of the Rondist diameter, and in special cuts strengths of 0.125 mms. For the final cutting operation in a fully cut brilliant (the cutting of the crown facets) the stone must therefore be supported by a "collar" of 0.1 mm. There remains a projecting portion of 0.025 mm. This type of cutting does not allow an external clamping of the chuck unless grinding of the chuck is admitted.

It is the object of the present invention to provide a mounting assembly with detent means allowing fail-safe operation and adapted to be adjustably but rigidly connectable to the carrier whereby the chuck allows a reliable self-centering positioning of the gem blank, and without exhibiting any of the drawbacks of prior art chucks.

This object is achieved in accordance with the present invention by the fact that the chuck is a self-clamping type chuck in adjustable threaded engagement with and secured to a detent ring having a division for interstices and semi-interstices, and another detent ring at the carrier includes an arbitrary basic division, is adjustable relatively to the carrier and serves as a guide for the first-mentioned detent ring. Due to the self-clamping feature of the chuck the stone is automatically centered and is evenly held. The chuck head may especially be of a configuration by which are largely avoided engagements with the cutting wheel.

The here employed term "interstice by interstice" relates to a facet pattern in a basic division.

Preferably, several elastic clamping jaws are made integral with a shaft and are adapted to be resiliently expanded for receiving a rounded stone blank by internal expanding means whereby the receiver for the stone is machined so as to be concentric with the outer diameter of the external wall surface. By this fact, the head of the chuck is devoid of external attachment means, and the clamping jaws directly arranged on the shaft ensure perfect truth of rotation.

Advantageously there are provided exchangeable chucks of different receiver designs or respectively head portions.

Preferably, the clamping jaws include a central interior cone in which is provided a ball serving as an expanding means and adapted to be biased by an axially and centrally movable clamping pin. Suitably, two to eight and preferably four clamping jaws are provided.

Advantageously, the clamping pin includes an externally threaded portion adapted to threadedly engage a mating internal thread of the chuck. By this fact the clamping pin may be moved by definite amounts whereby the mentioned internal thread of the shaft may additionally be used for another purpose for locking the shaft in one of the detent rings.

With the expanding means indicated, the shaft and the clamping jaw assembly advantageously are provided with a bore adapted to be freed by removing the expanding means and allowing an optical control of the seat of a polished table when cutting the rear facets. This is an additional advantage of the assembly of the present invention.

A decisive factor is that the precision division is likewise transferred free of errors onto the position of the stone intended to be cut. Therefore, the chuck safely retaining the stone through a self-clamping feature even at cutting temperatures of 400° C. is threadedly, adjustably connected to the detent assembly and locked thereby. Under the condition that one side of the stone has been cut, the opposite side is being cut in another chuck. Thereby attention must be given to the fact that the main facets of the first side are positioned exactly above the main facets of the second side of the stone. Any faults at this point lower the commercial value of the brilliant. Therefore the position of the second side of the stone must be adjusted with respect to the first side. This may be done by inserting a facet of the first side of the stone into the slot of the chuck so that a luminous reflection may be made to coincide with a zero line by rotating the chuck within the detent assembly, i.e. within the first detent ring by small angular increments, and subsequently locking the same by means of an additional screw.

The geometry of a brilliant not only requires an even Rondist and precise facet angles but likewise that the brilliant is symmetrical with respect to its axis of rotation. Therefore the seat of the stone in the receiver (in the head of the chuck) must be controlled. This may be done by instruments for sensing the truth of rotation of the clamping jaws that have been made concentric with respect to the receiver.

According to a particularly preferred embodiment of the present invention the chuck is mounted within a carrier, a so-called dop, having a bore for the shaft of the chuck and an internal detent ring at the end of the carrier remote from the clampng jaws, the shaft being adapted to be fixed by the internal detent ring which is rotatably journalled within an external detent ring provided with detent means relatively to the carrier and adjustable according to a selected basic division provided by the detent means.

The two detent rings, the one being disposed centrically within the other, provide the basic division and the offset by interstice or semi-interstice of the facets separately, with the advantage that the basic division for any desired offset remains always the same so that no new divisional errors may be introduced. Apart from that the cutting operator need not pay particular attention to the selection of facets. It is excluded that cutting errors may be caused thereby. Experience has shown that the desired facet angles were precise to $\pm 1.5$ angle minutes, and this is convincingly documented by the brilliancy of the brilliant.

According to a suitable embodiment a plurality of detent rings of various divisions are mutually exchangeable. This readily allows an adaptation to various divisions. Advantageously, attachment means are provided between the internal and external detent rings, and these attachment means allow a positioning of the internal and external detent rings in different respective angular relationships. By this arrangement the design is simplified. The attachment means may consist of a detent screw with with are associated bores or respectively threaded bores in the internal and external detent rings. Alternately, releasable attachment means such as a spring loaded ball or a spring loaded detent pin may be provided for selective engagement between internal and external detent rings. The internal detent ring may include a plurality of receivers for the attachment means whereby these receivers are associated with different types of facets and are inclined at correspondingly different angles.

Advantageously, a lock screw for fixing the rotational position of the chuck with respect to the internal detent ring is threadedly engaged with an internal thread within the bore of the shaft. Toward this end may be employed the already mentioned internally threaded portion at the shaft end whereby an external thread at the shaft end allows an adjustable threaded engagement with the internal detent ring.

In the following the present invention will be described more in detail with reference to an embodiment shown in the appended drawings wherein FIG. 1 is a sectional elevational view of the chuck and the detent rings within the dop carrier, for the cutting operation;

The basic division of the detent assembly may be arbitrarily selected and conform to 8 or 11 or any number between 3 and 17. The basic division necessarily entrains an adapted interstice division. The chuck may include from 3 to 8 clamping jaws. The head of the chuck may be profiled differently for securely retaining a particular stone blank.

Figure 1:
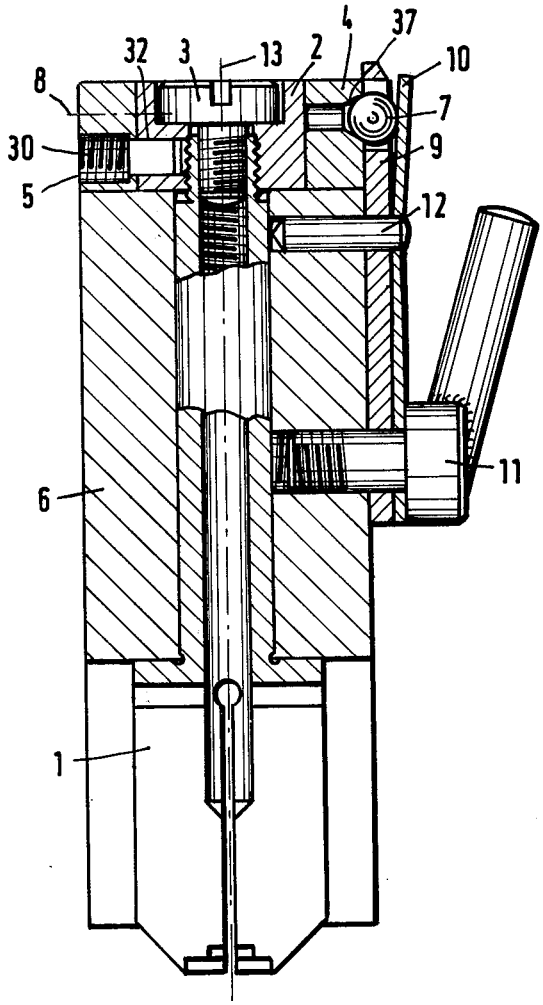
Figure 3:
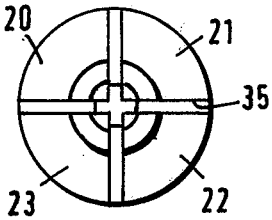
FIG. 3 is a top view of the four-member chuck of FIG. 2.

FIG. 1 is a longitudinal sectional view of a chuck 1 secured in a so-called dop or carrier 6. The chuck 1 includes a shaft 18 at which are arranged the four clamping jaws such as the four clamping jaws 20 to 23 shown (FIG. 3). These clamping jaws are separated by slots one of which is indicated in FIG. 3 by the reference numeral 35. The shaft 18 includes at its end a center bore 36 extending to an intermediate height of the clamping jaws and merging into a central interior cone 19. At its end remote from the clamping jaws the shaft 18 is provided with an externally threaded portion 29 and an internal thread 26, and these threads preferably consist of fine threads.

Figure 6:
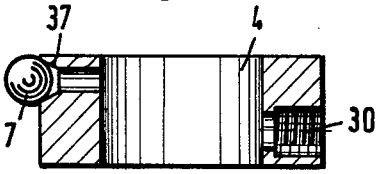
FIG. 6 is a sectional view of a detent ring and more particularly of the external detent ring of FIG. 1.
Figure 7:
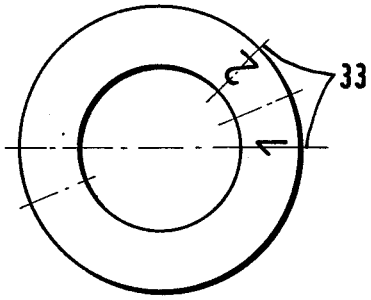
FIG. 7 is a top view of the detent ring of FIG. 6.
Figure 8:
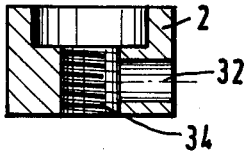
FIG. 8 is a sectional view of the internal detent ring of FIG. 8.
Figure 9:
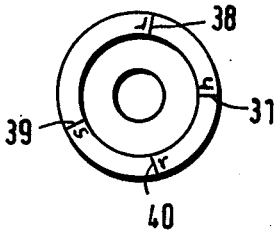
FIG. 9 is a top view of the internal detent ring of FIG. 8.

The shaft is threadedly engaged, by its external thread 29, with an internal thread 34 of an internal detent ring 2. According to FIG. 3 the chuck 1 will initially be adjusted into the correct rotational position with respect to the dop 6, and then its position in the internal detent ring 2 is locked by means of a lock screw 3 threaded into the internal thread 26 of the shaft. The internal detent ring 2 is fitted, without any free play, into the external detent ring 4 (FIGS. 1 and 6), and is secured in its rotational position by a detent screw 5. This detent screw 5 threadedly engages a threaded bore 30 (FIG. 6), and the shaft of this screw extends into a finished bore 32 of the internal detent ring (FIGS. 1 and 8). There are provided four internal bores of this type in the internal detent ring 2, as shown by the arrangement of FIG. 9. The assembly comprising the external detent ring 4 and the internal detent ring 2 is held in angular position relative to the dop 6 by a detent ball 7. This detent ball 7 engages detent recesses 37 of the external detent ring 4. The external detent ring 4 includes a circular array of 8 detent recesses 37 according to the basic division 8 of the division magnitudes the positions of which are indicated by the reference numeral 33 in FIG. 7. For this reason the assembly comprised of the rings 2 and 4 may be rotated and fixed to eight separate angular positions relative to the dop 6 according to the basic division. The detent ball 7 is retained, free of play, within a guide of a plate 9 and is biased by a spring 10 into engagement within the recesses of the ring 4 which define the basic division. The plate 9 is secured by a detent screw 11 and a detent pin 12 that serve to eliminate angular play about the pivot axis 13 of the dop 6.

Figure 2:
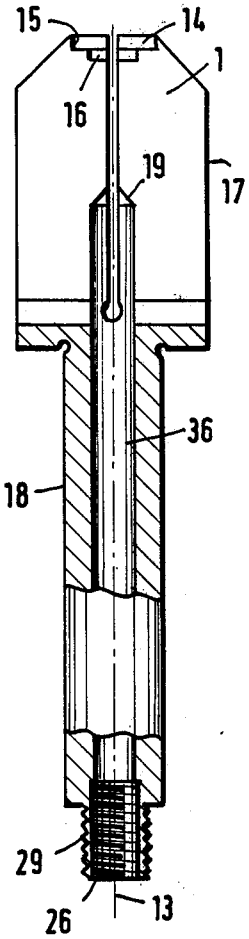
FIG. 2 is a sectional view of the chuck of FIG. 1.

As shown in FIGS. 2 and 3, the four-member chuck 1 includes a head portion 14 of a configuration adapted to a specific cutting operation. The head portion 14 shown is adapted for cutting the rear facettes of a brilliant whereby the receiver 15 serves as a seat for the brilliant or gem blank. The diameter of a center recess 16 corresponds to approximately 60% of the diameter of the receiver 15 so that the brilliant touches only by its table portion the metal of the receiver 15 of the chuck, and this table portion will anyhow be cut away when later cutting the crown facets. By this fact it is advantageously avoided that parts of the later table of a hot stone that has been heated by cutting may react with the metal of the chuck.

The diameter of the receiver 15 is concentric with the external wall surface 17 of the clamping jaws 20–23 of the chuck 1. By this, the accuracy of rotation of the chuck 1 holding a mounted stone blank may be checked in the region of the wall surface 17.

The chuck 1 is arranged so that the table of a mounted stone on the receiver 15 may be controlled optically for accuracy of rotation in the direction of the axis 13 when the chuck 1 with the mounted stone is laid by its shaft 18 into a prism and then rotated.

Figure 5:
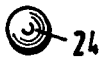
FIG. 5 is a view of the ball serving as expanding means for opening the chuck of FIG. 2.
Figure 4:
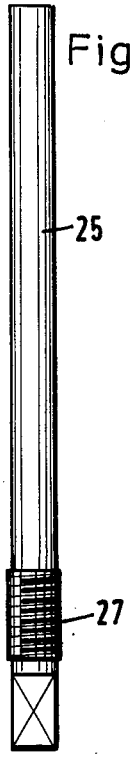
FIG. 4 is a view of a clamping pin having an externally threaded portion.

The already mentioned central interior cone 19 at the end of the bore 36 serves as an abutment for a ball 24 (FIG. 5) serving as an expanding means and adapted to be biased evenly by a clamping pin 25 (FIG. 4) whereby the clamping pin, by its external thread, may be rotated within the internal thread 26 of the shaft 18. In this manner the clamping jaws 20–23 may be evenly expanded for mounting the stone into the chuck 1.

After the stone has been mounted, the pin 25 and the ball 24 are removed from within the bore 36 to facilitate checking of the alignment of the stone by viewing through the bore 36.

After an optical check of the mounting position of the stone in the chuck 1 by viewing through the bore 36 and establishing that the stone is mounted free of wobble (to within an admissible few arc minutes), the chuck 1 is mounted as described into the dop 6 whereby the external thread 29 is threadedly engaged into the internal thread 34 of the internal detent ring 2 and then locked by the lock screw 3. The external detent ring 4 (FIGS. 1 and 6) may be locked relative to the internal detent ring 2 by the detent screw 5 (FIG. 1) and the threaded bore 30 e.g. in the position 31 (FIG. 9) of the internal detent ring 2 whereby the shaft of the detent screw engages the finished bore 32 free of play. The parts 7, 9, 10, 11 and 12 then allow a perfect indexing at the basic division 8 or respectively 33 (FIGS. 1 and 7) of the external detent ring 4 so that the rear facets of a brilliant may be cut by indexing the detent assembly with the chuck 1 step by step through the indexing or division positions 33.

For cutting the crown side, the chuck 1 is adjusted by means of the fine thread 29 at the outside of the shaft 18 (FIG. 2) and the internal thread 34 of the internal detent ring 2 (FIG. 7) so that the main facet on the rear side within a slot 35 (FIG. 3) appears optically on a zero line when the overall detent assembly consisting of the parts 1, 2, 4, 5, 7, 9, 10, 11 and 12 has been assembled. For this adjustment, initially the lock screw 3 is first slackened and then again tightened. In this manner a crown facet may be cut.

In line with this adjustment, the detent screw 5 will be engaged into a finished bore 32 associated with the type of facet that is intended to be cut. These finished bores 32 are not only provided in position 31 of FIG. 9 but likewise in the positions 38, 39 and 40. This allows with respect to the basic division or respectively the basic division 33 an adjustment by interstice or by semi-interstice.

Figure 10:
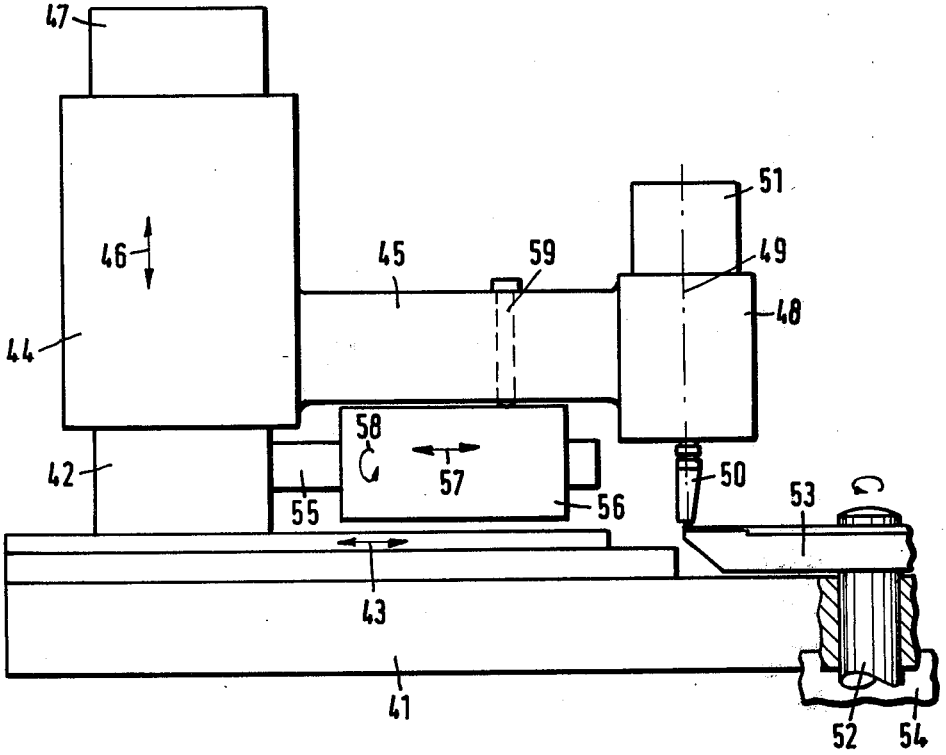
FIG. 10 is a schematical lateral elevational view of a cutting machine for explaining the usage of the chuck.

FIG. 10 illustrates the arrangement of the mounting assembly in a cutting machine of which only the essential parts are being shown. This diamond cutting machine includes a base 41 with a column 42 adapted to be moved in the direction of the double headed arrow 43 during cutting operation. Along this column is mounted, by a sleeve type bearing 44, a beam 45 adapted to be raised and lowered in the direction of the double headed arrow 46. For effecting elevational adjustments, a drive motor 47 may be arranged at the upper end of the column 42. The column 42 thus defines a vertical guide assembly.

The beam 45 carries a bearing 48 for a support 49 to which are attached at its lower end the above described mounting assembly, indicated generally be the reference numeral 50 and including the chuck 1. The support is preferably adjustable within the bearing 48, and the corresponding positioning devices are indicated by the reference numeral 51. The base furthermore mounts a shaft 52 for the cutting wheel 53. The shaft is connected to a motor 54. In the column 42 is disposed an arm 55 along which may suitably be adjusted an abutment 56 profiled in axial and circumferential directions in the direction of the arrows 57, 58. The beam guides a sensor 59 adapted to engage the abutment 56 toward the end of the cutting operation. The abutment determines the depth of cut according to the positioning of the abutment, and an engagement between the sensor and the abutment controls the lift-off movement of the diamond mounted in the mounting assembly from the cutting wheel 53.

Figure 11:
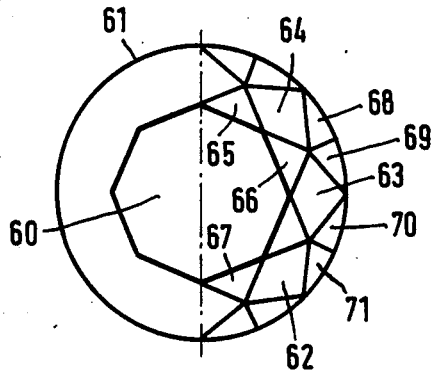
FIG. 11 is a top view of a brilliant.

FIG. 11 shows a top view of a brilliant, to explain the division by interstices and semi-interstices with respect to a basic division. The example of FIG. 11 illustrates an octagonal basic division, and for this reason the table or plate 60 is octagonal. Between the table and the Rondist 61 are arranged the facets. The main facets 62, 63, 64, . . . are mutually offset by 45°, in accordance with the basic division 8. The main facets include with the table triangular star facets 65, 66, 67, . . . . These star facets are positioned by interstices with respect to the main facets. With the indicated basic division 8, an interstice corresponds to an angle of 22.5°.

Between the main facets 62, 63, 64, . . . there are included two Rondist facets each 68, 69; 70, 71; . . . toward the Rondist 61. The Rondist facets are offset with respect to the basic division by a semi-interstice, i.e. in the present example with the basic division of 8 by an angle of 11.25°.

It will of course be understood that with different basic divisions the interstices and semi-interstices correspond of course to different angles. The described apparatus with the division by interstices and semi-interstices allows extremely high precision cutting.

With the assembly 50 containing the stone to be cut mounted as shown in FIG. 10, the entire assembly may be adjusted to tilt the axis 13 relative to the cutting surface to a desired angle depending upon the facets which are to be cut. With the axis 13 properly oriented, the stone may then be angularly indexed in a very accurate manner to any one of sixty-four different angular positions. This may be accomplished by rotating the assembled detent rings 2 and 4 to the eight basic positions defined by the eight recesses 37, with engagement of the ball 7 in any one of the recesses operating to hold the assembly at a given angular position. In addition, the inner ring 2 may be indexed relative to the outer ring 4 by operation of the detent screw 5. Since the ring 2 may be turned to four different angular positions relative to the ring 4 for each of the eight angular settings of the ring 4, a total of sixty-four indexing positions may readily be achieved with great accuracy.

While a specific embodiment of the invention has been shown and described in detail to illustrate the application of the inventive principles, it will be understood that the invention may be embodied otherwise without departing from such principles.

What is claimed is:

1. A mounting assembly particularly for mounting precious stones in a cutting and polishing machine comprising: a chuck with a first and a second end including a plurality of resilient clamping jaws defining at said first end means for seating and clamping a precious stone, said chuck including an inner axial bore extending from said second end to said first end to enable viewing from said second end of a stone seated and clamped in said first end; a dop having said chuck operatively supported therein; indexing means for enabling angular adjustment of said chuck relative to said dop; and inner expanding means adapted to be inserted into and operatively moved within said bore of said chuck from said second end thereof to effect expansion of said resilient clamping means to enable placement and location of a stone within said seating and clamping means in a position for cutting and polishing thereof; said inner expanding means being removable from within said bore after said stone has been seated and clamped in a desired position to enable checking of the position of said stone by viewing through said bore from said second end of said chuck.

2. A mounting assembly according to claim 1 wherein said inner expanding means comprise means proximate said second end of said inner axial bore defining therein a conical inner wall at the interior of said clamping jaws, a ball adapted to be placed within said axial bore for engagement against said conical inner wall and a clamping pin axially movable within said axial bore to apply a force against said ball to press said ball into abutment against said conical wall to effect expansion of said resilient clamping jaws.

3. A mounting assembly according to claim 1 wherein said indexing means comprise an inner detent ring mounted adjacent said second end of said chuck and fixed relative thereto; an outer detent ring extending generally concentrically relative to said inner detent ring and mounted for angular movement relative thereto; first locking means for enabling said inner detent ring to be releasably locked relative to said outer detent ring in any desired one of a first given plurality of relative angular positions; and second locking means operatively engaged between said dop and said outer detent ring for enabling both said inner and outer detent rings to be releasably locked in any desired one of a second given plurality of angular positions relative to said dop.

4. A mounting assembly according to claim 1 wherein internal thread means are provided within said axial bore and wherein said clamping pin is provided with external thread means adapted to be threadedly engaged within said internal thread means to enable said clamping pin to effect axial movement within said chuck by interengagement of said internal and external thread means.

5. A mounting assembly according to claim 1 wherein said portion of said chuck which includes said resilient clamping jaws is formed with a generally circular outer surface, said clamping jaws being formed with a receiving profile which is adapted to receive and engage said precious stones, said receiving profile being formed in said clamping jaws concentrically with said generally circular outer surface.

6. An assembly according to claim 1 wherein said resilient clamping jaws comprise four individual clamping jaws.

* * * * *